US006317888B1

(12) United States Patent
McFarlane

(10) Patent No.: US 6,317,888 B1
(45) Date of Patent: Nov. 20, 2001

(54) KNEEPAD

(75) Inventor: Maxwell Kenneth McFarlane, Warrandyte (AU)

(73) Assignee: Knee-On Australia Pty Ltd., Warrandyte (AU)

( * ) Notice: Subject to any disclaimer, the term of this patent is extended or adjusted under 35 U.S.C. 154(b) by 0 days.

(21) Appl. No.: 09/614,287

(22) Filed: Jul. 12, 2000

(30) Foreign Application Priority Data

Apr. 26, 2000 (AU) ..... PQ7130

(51) Int. Cl.[7] ..... A41D 13/06
(52) U.S. Cl. ..... 2/24; 602/26
(58) Field of Search ..... 2/22, 24, 455, 2/911, 16, 271, 59, 46, 170, 21, 163; 128/878, 881, 882; 602/23, 26, 62

(56) References Cited

U.S. PATENT DOCUMENTS

| | | | | |
|---|---|---|---|---|
| 2,418,197 | * | 4/1947 | Sherer | 2/46 |
| 3,587,572 | | 6/1971 | Evans . | |
| 3,728,736 | * | 4/1973 | Pugh | 2/21 |
| 3,772,704 | | 11/1973 | Carbonneau . | |
| 4,681,012 | * | 7/1987 | Stelma et al. | 2/160 |
| 5,031,240 | | 7/1991 | Nierhaus . | |
| 5,301,370 | | 4/1994 | Henson . | |
| 5,334,135 | | 8/1994 | Grim et al. . | |
| 5,347,657 | * | 9/1994 | Unsell | 2/67 |
| 5,500,955 | | 3/1996 | Gongea . | |
| 5,537,689 | | 7/1996 | Dancyger . | |
| 5,760,868 | * | 6/1998 | Jannard et al. | 351/153 |
| 5,794,261 | | 8/1998 | Hefling . | |

* cited by examiner

*Primary Examiner*—Gloria M. Hale
*Assistant Examiner*—Tejush Patel
(74) *Attorney, Agent, or Firm*—Banner & Witcoff, Ltd.

(57) ABSTRACT

A knee pad includes a multiple layer elongate member conformed to fit over a knee. The middle layer comprises a rigid polymeric material with projecting arms that encircle the leg and clasp the knee pad thereon. An inner cushion layer and an outer semi rigid layer enhance the comfort of the knee pad. The flexible arms include a supplemental reinforcing rib and the arms are positioned so as to support the knee pad by engaging the leg of a wearer below the knee.

31 Claims, 2 Drawing Sheets

KNEEPAD

The present invention relates to a protective padding for use on joints on the body but particularly for protection of the knee.

Kneepads are used in protecting elbows and knees during sporting and leisure activities such as roller blading and gardening. Trades persons such as carpenters use knee pads since kneeling on hard surfaces is a regular activity in the trade. Traditional protective kneepads comprise rigid pad members fitted to the knee with straps above and below the knee. This has been found to be uncomfortable for the wearer as the straps tend to dig into the wearer's flesh when the knee is bent. The rigidity of the pad member does not allow the kneepad to bend with the knee which causes digging of the straps into the back of the knee. Whilst it has been found that less rigid pads meliorate comfort, there is still sufficient pull on the straps of more flexible pads to cause discomfort to the wearer.

Variations to the traditional kneepad include providing a single strap designed to wrap around the leg just below the back of the knee. Whilst this design has proved moderately successful, there is some discomfort and inconvenience with the strap slipping or gathering behind the leg.

The present invention intends to overcome the above problems by providing a kneepad that is comfortable to wear at all times and that will firmly remain on the leg.

SUMMARY OF THE INVENTION

According to the present invention, there is provided a kneepad comprising an elongate member formed from an elastomeric material adapted to cover the front of a knee, the member having a front surface and a rear surface, and substantially rigid arms extending from a lateral, lower portion of the elongate member and rearwardly of the member such that, in use, the arms grip around a wearer's leg below the knee extending only partly around the leg.

The arms are preferably curved and may include straight sections to fit and grip around a leg by conforming to the shape of a leg. There are preferably a plurality of parallel arms extending laterally of the elongate member, and more preferably three arms. Cushioning pads can be provided on the ends of the arms to increase comfort for the wearer.

Preferably, the front surface of the elongate member is convex whereas the rear surface is concave to accommodate the shape of the knee. The elongate member is preferably formed with an outer layer, a middle layer and an inner layer fixed together. The arms are preferably an extension of the middle layer which is formed of a substantially rigid material such as polyvinyl chloride. The outer layer is preferably semi-rigid and typically made from medium density polyurethane. The inner layer is a cushion made from natural rubber or the like.

The front surface further preferably comprises a series of flexible individual segments defining an arc in an upper portion of the elongate member.

BRIEF DESCRIPTION OF THE DRAWINGS

An embodiment, incorporating aspects of the invention, will now be described by way of example only with reference to the accompanying drawings in which.

DETAILED DESCRIPTION OF THE PREFERRED EMBODIMENT OF THE INVENTION

Figures 1, 2, 3:
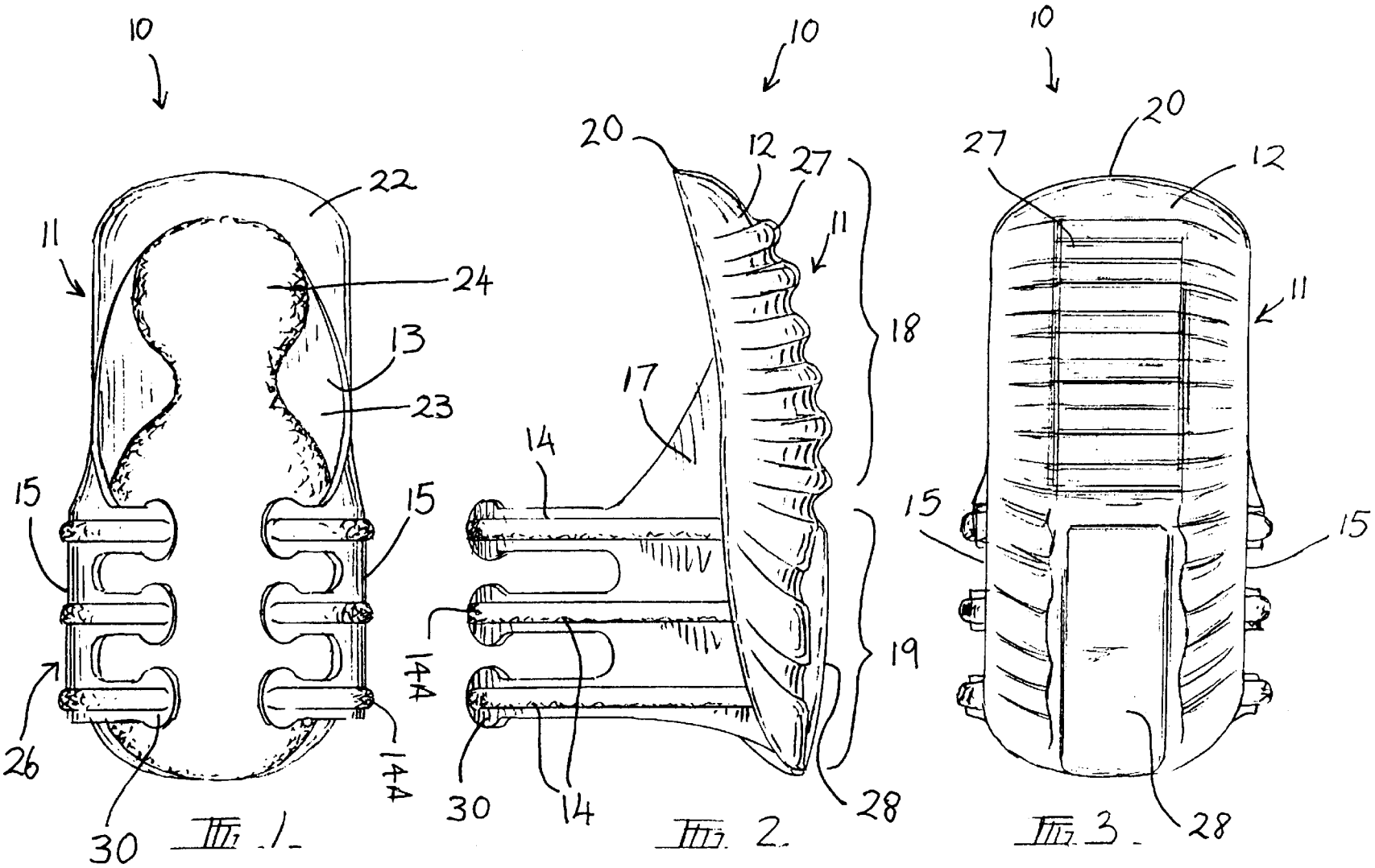
FIG. 1 is a rear view of the kneepad according to the present invention.
FIG. 2 is a side view of the kneepad.
FIG. 3 is a front view of the kneepad.

A kneepad 10 as illustrated in the figures comprises a main, elongate pad member 11 with a front surface 12 and a rear surface 13 and having substantially rigid, curved arms 14 extending rearwardly from each side 15 of the pad member 11 and from a lower portion of member 11. Specifically, there are three curved arms extending rearwardly from the sides 15 of the pad member. Webbing 17 between the arms and pad member 11 reinforce the structural rigidity of the arms 14. A longitudinal rib 14A supplements the grasping force and integrity of arms 14. The kneepad 10 is adapted to fit over a knee with the arms 14 wrapping around the leg immediately below the knee. However, the arms 14 only extend partly around the leg leaving the back of the leg clear and unencumbered resulting in greater comfort and flexibility for the wearer. The arms 14 are curved and biased towards each other and have sufficient flexibility to allow them to be pulled slightly apart to fit the kneepad 10 onto a leg. The pressure exerted by the biased arms 14 on the leg is sufficient to ensure the kneepad 10 does not slip but remains comfortably on the leg.

Figure 4:
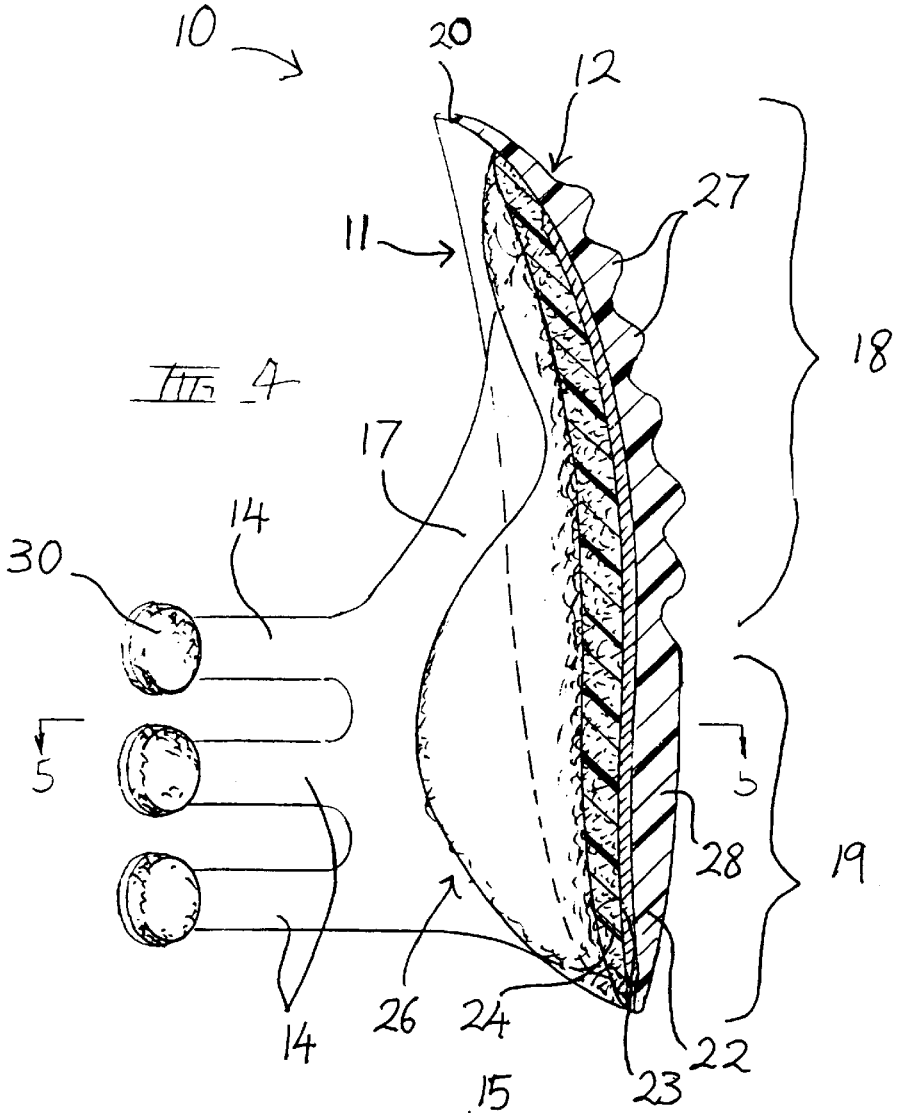
FIG. 4 is a side sectional view of the kneepad.
Figure 5:
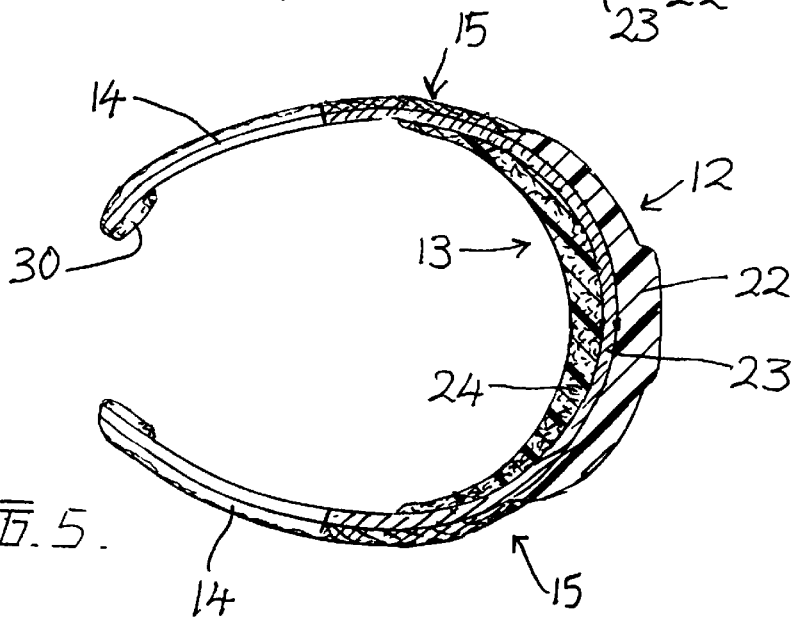
FIG. 5 is a top sectional view of the kneepad at section 5—5 of FIG. 4.

The elongate pad member 11 is curved to conform to the shape of the knee. The front surface 12 is therefore convexed and the rear surface 13 concaved. An upper section 18 of the pad member 11 fits neatly over the knee and leg immediately above the knee whilst a lower section 19 surrounds the front lower leg below the knee. Further to being curved to fit the circumferential shape of the leg, the upper section 18 is also inclined rearwardly by approximately 15° to provide more coverage to the knee and the area immediately above the knee. This inclination is apparent from FIGS. 2 and 4. The inclination of upper section 18 is such to provide maximum protection to the knee when the leg is bent or straight but is not too far inclined to cause the upper edge 20 of upper section 18 to dig into the wearer's leg when it is straight. As seen in FIG. 5, the curvature of arms 14 are opposed and follow on from the curvature of pad member 11 more or less according to the circumferential shape of a leg. The cross-sectional curvature of the kneepad 10 is, in fact, slightly smaller than the circumferential shape of the leg on which it is intended to be fitted because the arms 14 are required to exert a degree of pressure on the leg for the kneepad 10 to remain firmly in position. Since not all legs are the same size, it is envisaged that the kneepad 10 will be manufactured, in a range of curvature sizes to fit most legs. Circular cushions or pads 30 are provided on the end of each arm 14 to increase comfort and prevent arms 14 from digging into the wearer's flesh. Pads 30 further have contact surfaces with an adequate degree of friction to assist the kneepad 10 to remain in place on the leg.

Pad member 11 comprises three separate layers having a different material, construction and purpose: the outer layer 22, which defines the front surface, is formed from an elastic, medium density polyurethane; the middle layer 23 is formed from a hard polyurethane or polyvinyl chloride; and the soft inner layer 24, which defines the rear surface 13, is a natural rubber or other soft material. The layers are glued together by conventional means. Arms 14 are an extension of hard middle layer 23. Middle layer 23 takes the form of the curved elongate protection pad which covers the front of the leg with the arms 14 and webbing 17 extending rearwardly from a lower portion 26 of the middle layer 23. The material of the rigid middle layer 23 provides sufficient flexibility to enable the arms 14 to be separated when fitting and apply sufficient pressure to clasp on a leg to prevent the kneepad 10 from slipping. The frictional resistance of the rigid material layer 23 itself contributes in preventing slippage.

Semi-rigid outer layer 22 provides a stable and protective work platform that avoids uncomfortable rocking experienced when wearers of hard shell knee pads kneel on a surface. The semi-malleable face conforms to some extent to the work surface. As seen in FIGS. 2 and 3 front surface 12 includes a series of ridges 27 along the upper section 18. Ridges 27 run horizontally on convexed front surface 12. The lower section 19 of front surface 12 includes a planar rectangular section 28 provided centrally of the lower section 19. Ridges 27 are also provided on either side of planar section 28 but are wider and flatter than the ridges 27 of the upper section 18. The combination of ridges 27 and planar section 28 allow the pad to compensate for uneven kneeling surfaces and will assist in stability for the wearer. The semi-rigid front surface 12 further contains frictional characteristics which allow the kneepad 10 to grip and reduce sliding when worn on inclined or slippery surfaces. The semi-rigid outer layer 22 in combination with the rigid middle layer 23 provides a wearer with a high level of protection for the knee.

The soft inner layer 24 acts to directly protect the knee by absorbing impacts to the kneepad 10. Foam padding can be incorporated in the inner layer 24 to enhance its dampening effects. Since kneepads 10 are frequently worn on bare knees the inner layer 24 provides a comfortable contact surface against the knee and leg area immediately above and below the knee.

When standing, the kneepad 10 will cover the wearer's entire knee region as well as the leg immediately above and below the knee. Since the kneepad 10 is fitted to a leg immediately below the knee, it remains aligned with the knee and leg immediately below the knee when kneeling. Therefore, whether the wearer is standing or kneeling the kneepad 10 protects the knee and parts of the leg most prone to injury. The absence of retaining straps or arms around the leg above the knee eliminates discomfort of straps or arms pulling against the back of the knee experienced during kneeling when the upper section 18 of pad member 11 moves naturally away from the upper leg. Furthermore, given that the arms 14 extend only partly around the leg, the back of the leg is left free and unimpeded significantly improving comfort and circulation to the wearer's leg.

It will be understood to persons skilled in the art of the invention that many modifications may be made without departing from the spirit and scope of the invention.

For the purposes of this specification it will be clearly understood that the word "comprising" means "including but not limited to," and that the word "comprises" has a corresponding meaning.

What is claimed is:

1. A kneepad comprising:

an elongate kneepad member formed from an elastomeric material which covers the front of a knee, the member having a front surface, a rear surface, upper half side portions and lower half side portions; and substantially rigid arms extending from the lower half side portions of the elongate member and rearwardly of the member such that in use, the arms grip around a wearer's leg below the knee extending only partly around the leg.

2. The kneepad claimed in claim 1 wherein the arms are arcuate in shape to enable gripping around a wearer's leg.

3. The kneepad claimed in claim 1 wherein a plurality of parallel arms extend from each lower side portion of the elongate member.

4. The kneepad claimed in claim 3 wherein three parallel arms extend from each lower side portion of the elongate member.

5. The kneepad claimed in claim 1 wherein cushioning pads are provided on the ends of the arms to contact the wearer's leg.

6. The kneepad claimed in claim 1 wherein the front surface of the elongate member is convex and the rear surface is concave to accommodate the shape of a knee.

7. The kneepad claimed in claim 1 wherein the elongate member is formed with an outer layer, a middle layer and an inner layer.

8. The kneepad claimed in claim 7 wherein the arms are an extension of the middle layer.

9. The kneepad claimed in claim 7 wherein the middle layer is formed from a substantially rigid material.

10. The kneepad claimed in claim 9 wherein the substantially rigid material is polyvinyl chloride.

11. The kneepad claimed in claim 7 wherein the outer layer is formed from a semi-rigid material.

12. The kneepad claimed in claim 11 wherein the semi-rigid material is medium density polyurethane.

13. The kneepad claimed in claim 7 wherein the inner layer is formed from an impact absorbent material.

14. The kneepad claimed in claim 13 wherein the impact absorbent material is natural rubber.

15. The kneepad claimed in claim 1 wherein the front surface comprises a series of flexible individual segments defining an arc in an upper portion of the elongate member.

16. A kneepad comprising, in combination:

an elongate knee pad member formed to fit over a knee and including a concave back surface and a front surface, a first side and a second side opposite the first side, said member including a rigid, molded layer, said rigid molded layer including at least two integrally molded, curved arms extending from at least one side and at least one integrally molded, curved arm extending from the other side, said arms generally aligned in opposed relation to clasp onto a leg.

17. The kneepad of claim 16 further including an outer layer over the rigid layer, said outer layer formed from an elastic semi-rigid material.

18. The kneepad of claim 16 further including an inner layer of cushion material.

19. A kneepad comprising, in combination:

an elongate kneepad member having a front, a back, a first lower half side, a first upper half side, a second lower half side opposed to the first lower half side and a second upper half side opposed to the first upper half side, said back being concave to fit over a knee, said lower half sides each including an integral projecting, curved arm extending from the lower half side and over the backside to clasp a leg.

20. The kneepad of claim 19 wherein the arms including a reinforcing rib.

21. The kneepad of claim 19 wherein the arms include a medial reinforcing rib extending from the lower side.

22. The kneepad of claim 19 including at least two arms extending from each said first and second lower sides.

23. The kneepad of claim 19 wherein the arms are aligned on opposite sides of the elongate member.

24. The kneepad of claim 19 wherein the arms include a cushion member at the distal ends thereof.

25. The kneepad of claim 19 wherein the lower sides and arms are positioned to fit below a knee and the upper sides are positioned to fit at a knee.

26. The kneepad of claim 19 wherein the front in the region intermediate the upper sides is inclined relative to the front in the region between the lower sides ad said front of the elongate member is comprised of a semi-rigid material which conforms shape to surface against which the elongate member impinges.

27. The kneepad of claim 19 including alternating ridges and grooves in the front to facilitate flexibility of the kneepad.

28. A kneepad comprising, in combination:

an elongate kneepad member formed from a material which covers the front of the knee, the member having a front surface, a rear surface and two side portions, each side portion including a lower half, and at least two, substantially rigid arcuate arms extending from the lower half of each side portion and rearwardly of the elongate member such that in use the arms grip partially around the leg of a wearer below the knee.

29. A kneepad comprising, in combination:

an elongate kneepad member having a front, a back, a first lower side having a side portion, a first upper side, a second lower side having a side portion opposed to the first lower side and a second upper side opposed to the first upper side, said back being concave to fit over a knee, said lower sides each including at least two integral projecting, curved arms extending from the first and second lower side portions and over the back side to clasp a leg.

30. A kneepad comprising, in combination:

an elongate kneepad member having a front, a back, a first lower side, a first upper side, a second lower side opposed to the first lower side and a second upper side opposed to the first upper side, said back being concave to fit over a knee, said lower sides each including an integral projecting, curved arm extending from the respective lower sides and over the back side to clasp a leg, at least one arm including a reinforcing rib.

31. A kneepad comprising, in combination:

an elongate kneepad member formed to fit over a knee and including a concave back surface and a front surface, a first lower half side and a second lower half side opposite said first lower half side, said member including a rigid molded layer, said rigid molded layer including at least one integrally molded, curved arm extending from each of the first and second lower half sides and aligned to clasp onto a leg below the knee.

* * * * *